United States Patent [19]

Frost, Jr.

[11] 4,156,326

[45] May 29, 1979

[54] SIMPLIFIED STUFFING BOX REFACING TOOL

[76] Inventor: Marion E. Frost, Jr., P.O. Box 2738, Baltimore, Md. 21225

[21] Appl. No.: 908,193

[22] Filed: May 22, 1978

[51] Int. Cl.[2] ..... B24B 15/02

[52] U.S. Cl. ..... 51/241 VS; 408/83.5

[58] Field of Search ..... 51/241 VS, 241 R, 241 G, 51/241 S, 170 T; 90/12.5

[56] References Cited

U.S. PATENT DOCUMENTS

| | | | |
|---|---|---|---|
| 919,618 | 4/1909 | McBee | 51/241 VS |
| 2,412,859 | 12/1946 | Barnes | 51/241 VS |
| 2,418,206 | 4/1947 | Thompson | 51/241 VS |
| 2,431,369 | 11/1947 | Chiles | 51/241 VS |
| 3,942,289 | 3/1976 | Greer | 51/241 VS |
| 3,999,331 | 12/1976 | Trujillo | 51/241 S |

*Primary Examiner*—Nicholas P. Godici
*Assistant Examiner*—Roscoe V. Parker, Jr.
*Attorney, Agent, or Firm*—Sughrue, Rothwell, Mion, Zinn and Macpeak

[57] ABSTRACT

A stuffing box refacing tool takes the form of a cylinder positioned within the bore and counterbore of a pump stuffing box bearing axially adjustable different sized adaptor rings on its outer periphery with the rings having an outer diameter on the order of the pump stuffing box bore. Shoulders defined within the pump stuffing box and on the cylinder fix the rings and the cylinder axially relative to the box. The cylinder rotatably supports internally, a pilot mandrel which in turn carries the grinding wheel at one end with the end face of the grinding wheel acting to reface the end of the compressor housing stuffing box.

4 Claims, 3 Drawing Figures

SIMPLIFIED STUFFING BOX REFACING TOOL

FIELD OF THE INVENTION

This invention relates to a stuffing box refacing tool, and more particularly, to a tool of simplified construction and usable with pump housings having stuffing box bores of varying diameters and lengths.

BACKGROUND OF THE INVENTION

Various tools have come into being to facilitate the grinding or refacing of end faces of compressor housing stuffing boxes. In most cases, the tools consist of a fixed support member carried by the compressor casing bearing a rotatable pilot mandrel, which in turn supports the grinding wheel or like abrasive disc for contact with the end face of the pump or compressor stuffing box through which the mandrel extends, permitting the grinding of an end face essentially at right angles to the stuffing box bore. Representative patents showing such tools are: U.S. Pat. No. 2,431,369 to Chiles issuing Nov. 25, 1947; U.S. Pat. No. 2,412,859 to Barnes issuing Dec. 17, 1946; U.S. Pat. No. 3,942,289 to Greer issuing Mar. 9, 1976; and U.S. Pat. No. 3,999,331 to Trujillo issuing Dec. 28, 1976.

While such devices have permitted the grinding of an end face of a pump or compressor stuffing box or the like, the devices are either highly complicated or, if simplified, permit the grinding of but one sized pumping box bore, and are essentially limited to use on a machine of one given size.

The present invention has for its primary object the creation of an improved, simplified stuffing box refacing tool which may be easily assembled and disassembled, which may be easily mounted to the pump or compressor stuffing box, and which permits the utilization of simple interchangeable parts to adapt the refacing tool to pump or compressor stuffing boxes which are of varying lengths and which are provided with bores and counterbores of varying diameters.

SUMMARY OF THE INVENTION

The present invention takes the form of a stuffing box refacing tool for refacing of an axial end face of a compressor housing stuffing box of cylindrical form, and being bored and counterbored to define an internal shoulder at one end of the counterbore opposite the end of the cylinder bearing the axial end face which needs refacing. The tool comprises a tube or cylinder having an external diameter less than that of the housing bore and being receivable within that bore, first and second adaptor rings each having an internal diameter on the order of the outer diameter of the tube and an outer diameter on the order of the stuffing box counterbore. Means are provided for mounting one adaptor ring at the end of the tube closest to the grinding wheel disc for performing the refacing of the axial end face of the compressor housing cylinder and means for mounting the other of said adaptor rings axially displaced from the one and in contact with the shoulder formed by the counterbore within the housing stuffing box. Means rotatably support a pilot mandrel within the cylinder and bearing at one end a grinding wheel disc having a diameter in excess of the counterbore of the compressor stuffing box, such that by coupling the grinding wheel disc to a drill, the mandrel and the disc may be rotated with an end face of the grinding wheel disc in contact with the end face of the compressor housing stuffing box for refacing of that stuffing box end. By selection of adaptor rings correlated to the size of the bore and counterbore of the compressor housing stuffing box, the tool may be adapted to various sized compressor housings.

Preferably, the cylinder has a portion of increased outer diameter over a part of its length, intermediate of its ends, to form first and second shoulders with said first shoulder lying adjacent the end of the cylinder closest to the grinding wheel disc such that one of the adaptor rings bears on the first shoulder, while the second adaptor ring is positioned between the opposite end of the cylinder and the second shoulder. Preferably, a longitudinally adjustable locking collar is slidably mounted on the cylinder and located between the second adaptor ring and the second shoulder and is locked to the cylinder at a position determined by the axial length of the counterbore and within the compressor housing stuffing box. The second adaptor ring then bears against the stuffing box shoulder such that the second adaptor ring constitutes an axial stop during operation of the tool in grinding and refacing of the axial end face of the compressor housing stuffing box when the mandrel and the grinding wheel disc are pressed axially towards the pump stuffing box to place the side of the grinding wheel disc in contact with the end face of the compressor housing stuffing box.

DESCRIPTION OF THE PREFERRED EMBODIMENT

Figure 1:
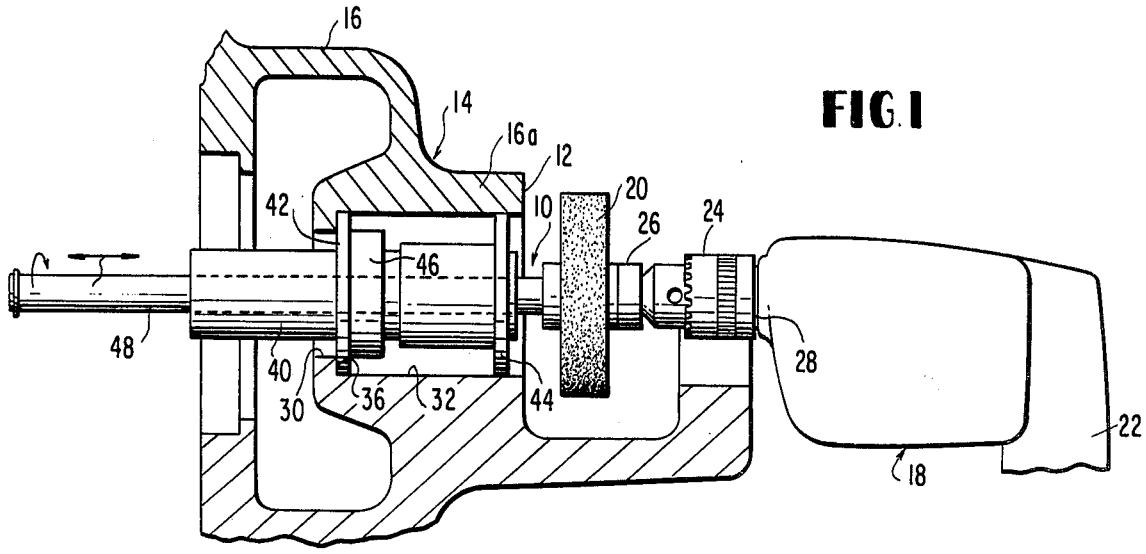
FIG. 1 is a sectional view of a compressor housing stuffing box with the improved stuffing box refacing tool of the present invention mounted therein and positioned to effect a refacing operation.

The stuffing box refacing tool, which is shown generally at 10 in FIG. 1, has application to the refacing by grinding of an axial end face as at 12 of a pump or compressor housing stuffing box indicated generally at 14 and forming a portion of the pump or compressor housing 16, the remaining portion not being shown. Additionally in FIG. 1, a conventional electric drill indicated generally at 18 provides the necessary power for rotating of a grinding wheel disc 20 to achieve the refacing operation, the electric drill being held by its handle 22 and being provided with a chuck 24 which grips a drive head 26 to effect that operation by energization of the drill drive motor (not shown) and acting to drive the chuck 24 through an output shaft 28.

The compressor housing stuffing box, indicated at 14, is formed by a cylindrical portion **16*a* of the housing, which cylindrical portion is of some axial length or thickness and being provided with a bore 30 at its axially inner end and with a counterbore 32 which extends axially inwardly from end face 12 but terminates short of the opposite end face 34 to define a pump or compressor stuffing box shoulder 36**.

Normally, the compressor or pump is comprised of a central shaft which is not shown, mounted by way of bearings carried within the cylindrical portion **16*a* of housing 16, and being provided with a seal (not shown) for the shaft portion projecting from the housing and being coupled to a drive motor or the like, the seal being effected at end face 12. Thus, that end face is required to be smooth. During wear, leakage develops at the end face 12 and this is the requirement for refacing by way of the grinding wheel disc 20**.

During the refacing of the end face 12, by way of refacing tool indicated generally at 10, the housing of necessity must have the shaft and other componentry at that end removed so as to permit the refacing of the end face 12. It is in this condition that the housing is illustrated in FIG. 1 to permit the refacing operation.

Figure 2:
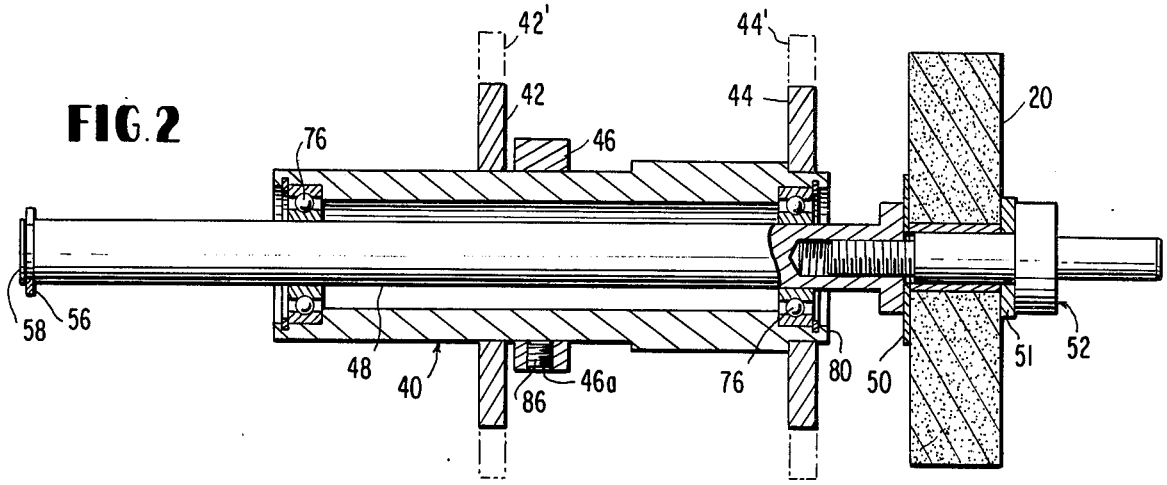
FIG. 2 is an enlarged sectional view of the stuffing box refacing tool of the present invention.
Figure 3:
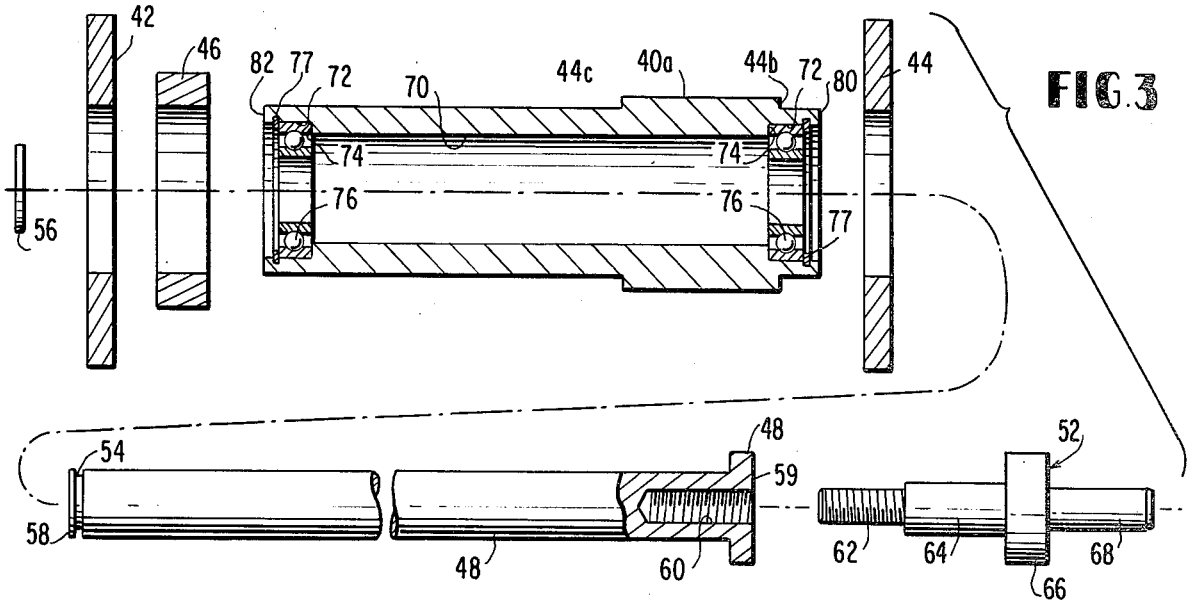
FIG. 3 is an exploded, sectional view of the stuffing box refacing tool of FIG. 2, showing the manner of assembly of the components thereof.

The principal components of the stuffing box refacing tool 10 are the adaptor assembly cylinder or tube indicated generally at 40, a pair of stuffing box adaptor rings 42 and 44, a locking collar 46, a pilot mandrel 48, the grinding wheel assembly 20 including disc 20 and a drive head indicated generally at 52. The assembly of these elements may be appreciated by further viewing of FIGS. 2 and 3, particularly the exploded view of FIG. 3. The components with the exception of disc 20 may be formed of stainless steel or the like. The mandrel 48 comprises a solid rod including an enlarged diameter head 48*a* and being provided at one end with a large diameter head 48*a* and being of equal diameter throughout its length, from head 48*a* towards end 58 which bears a groove 54 for receiving a split locking ring 56 for locking the mandrel 48 to the cylinder or tube 40. The end 59 of the mandrel 48, opposite end 56 bearing groove 54, is centrally tapped and threaded as at 60 so as to receive the threaded end 62 of the drive head 52, the drive head 52 comprising a rod having its threaded end portion 62 of a diameter approximately that of the tapped and threaded bore 60 within the pilot mandrel 48. The rod further includes a slightly enlarged diameter portion 64, a further enlarged diameter portion 66, and terminates at the end opposite the threaded portion 62 in a non-threaded, reduced diameter portion 68 approximating the diameter of the threaded end 62.

The grinding wheel disc 20 is borne by a cylindrical element 51 having an internal diameter on the order of the diameter of portion 64 of the drive head 52 and receives that portion of the drive head, such that the further enlarged diameter portion 66 acts to press the grinding wheel assembly 50 and fixedly lock the same against the enlarged diameter head 48*a* of the pilot mandrel 48, when the drive head 52 is threaded to end 58 of the pilot mandrel 48.

In terms of the adaptor assembly tube or cylinder 40, the cylinder 40 is provided with a bore 70, and is counterbored at both ends as at 72 to define opposed shoulders 74 against which bear the ends of respective ball bearings 76. The ball bearings 76 are maintained fixedly on the cylinder 40 by snap rings 77 which are mounted within grooves 78 of the counterbore 72. The ball bearings 76 have an internal diameter on the order of the diameter of the pilot mandrel 48 such that the pilot mandrel 48 is slidably received by the ball bearings 76 and rotates about the pilot mandrel axis within cylinder or tube 40. The pilot mandrel 48 is insertable within the tube or cylinder 40 from one end to the extent of head 48*a* which may bear against the adjacent ball bearing 76. However, in actual practice, because of the presence of the grinding wheel disc 20, the end face 20*a* of the disc bears against the end face 12 of the pump or compressor stuffing box cylinder portion 16*a* to achieve the desired refacing of that surface.

Of particular importance to the present invention is the utilization of a pair of adaptor rings 42 and 44, which are essentially identical and which may be formed of stainless steel. The rings 42 and 44 are interchangeable depending upon the diameter of the counterbore 32 within the stuffing box of the pump or compressor housing which requires refacing of its end face as at 12, FIG. 1. In that regard, a plurality of adaptor rings may be provided having different outer diameters but essentially the same inner diameter. Thus, the rings 42 and 44 are interchangeable with rings indicated at 42' and 44' in dotted line fashion, FIG. 2, which rings 42' and 44' have the same internal diameter but have larger external diameters and are of the same thickness.

With respect to mounting of the stuffing box adaptor rings 42 and 44, on the adaptor assembly cylinder or tube 40, it may be seen that the cylinder 40 is provided with an enlarged diameter portion 40*a* near one end and forming a first shoulder 44*b* and a second shoulder 44*c* at opposite ends. The first shoulder 44*b* is spaced axially with respect to one end face 80 of cylinder 40, by distance somewhat in excess of the thickness of ring 44, while the second shoulder 44*c* is quite remote from the opposite end face 82 of cylinder 40, thus permitting the stuffing box adaptor ring 42 or its alternative ring 42' for instance, to be shifted axially and located at a distance limited only by end face 82 of the cylinder 40 and second shoulder 44*c*. Also slidably mounted on the cylinder 40 is locking collar 46, the locking collar 46 having an internal diameter on the order of the tube or cylinder 40 and having an external diameter considerably less than the external diameter of the stuffing box adaptor ring 42. The locking collar 46 includes a radially tapped and threaded bore 46*a* which bears a threaded plug 86, the plug 86 being rotated to frictionally lock the locking collar 46 at a given longitudinal position with respect to the cylinder 40 and between the stuffing box adaptor ring 42, ring 42 being otherwise free to slide longitudinally on the cylinder 40. In order to maintain the pilot mandrel on the cylinder 40, the snap ring 56 is mounted within the groove 54 after the end 56 of the pilot mandrel is projected through the paired ball bearings 76 from the right side of the cylinder 40 from right to left with respect to cylinder 40.

In terms of positioning and locking the collar 46 longitudinally of the adaptor assembly cylinder 40, the adaptor assembly is first positioned within the counterbore 32 and bore 30 of the pump or compressor stuffing box cylinder portion 16*a* to the extent where the stuffing box adaptor ring 42 abuts shoulder 36 with the adaptor ring 44 being positioned just inside the end face 12 of the stuffing box housing cylinder portion 16*a* to be refaced and against shoulder 44*b*. By locking the locking collar 46 in a position with the stuffing box adaptor ring 42 in contact with the side of that locking collar 46, it is quite apparent that upon the positioning of the adaptor assembly in the manner of FIG. 1, further axial insertion of the pilot mandrel 48 into the cylinder 40 from right to left will cause the edge 20*a* of the grinding wheel disc 20 to abut the end face 12 of the pump or compressor stuffing box cylinder portion 16*a* and by energizing the electric drill 18, the end face can be appropriately ground thus refacing the cylinder with the tool properly trued, with the grinding wheel disc 20 properly trued. The ball bearings 76 provide minimal frictional restraint to the rotation of the mandrel and the supported grinding wheel disc 20, the axial spacing of the bearings 76 providing full support for the assembly and further insuring preventing the vibration of the pilot mandrel 48 acting as the shaft extension for the grinding wheel disc 20 and its drive head 26. The invention provides a fast mounting, efficient adaptor assembly, meeting the needs of the various sized compressors or pumps by the simple expedient of substitution of rings of different external diameter as readily seen in FIG. 2 while longitudinal adjustment of the locking collar properly positions the stuffing box adaptor ring to maximize the extent of support of the pilot mandrel 48 as it is driven about its axis through drive head 26, particularly under the pressure applied by the grinding wheel against the end face 12 being refaced or reground.

While the invention has been particularly shown and described with reference to a preferred embodiment thereof, it will be understood by those skilled in the art that various changes in form and details may be made therein without departing from the spirit and scope of the invention.

What is claimed is:

1. A stuffing box refacing tool for refacing an axial end face of a compressor housing cylindrical stuffing box, said stuffing box being bored and counterbored to define an internal shoulder at one end of the counterbore, said tool comprising:

a cylinder having an external diameter less than that of said housing bore and being received within said bore, a radially enlarged portion of said cylinder intermediate of its ends and defining a first axial shoulder closely adjacent one end of said compressor housing cylindrical stuffing box facing axially outwardly of said compressor housing and a second axial shoulder remote from the oppoiste end face of said cylinder, first and second adaptor rings, each having an internal diameter slightly greater than the external diameter of said cylinder between said shoulders and the ends of said cylinder and an outer diameter on the order of the stuffing box counterbore, means for mounting one of said adaptor rings on one end of said cylinder and in contact with said first shoulder to support said cylinder within said cylindrical pump stuffing box adjacent the end face to be refaced, means for axially adjustably fixing said second adaptor ring, axially displaced from said first ring on said cylinder and in contact with said stuffing box shoulder, and a pilot mandrel projecting through said cylinder and mounted for rotation about said pilot mandrel axis within said cylinder and bearing a grinding wheel disc at one end thereof, said pilot mandrel including a drive head at that end thereof projecting axially beyond the end face of said stuffing box cylindrical portion to be refaced, such that by chuck coupling of said drive ends to an electric drill and by pressing axially on said drill, chuck driving energization of said drill, said end face of said grinding wheel disc is pressed against the end face of said compressor housing stuffing box to be refaced, said second adaptor ring is pressed against the shoulder of said pump stuffing box and said mandrel is supported by said adaptor ring along an extent of its length to cause said grinding wheel disc to be trued relative to said stuffing box and said end face to be refaced; and wherein adaptor rings of differing external diameter may be selectively mounted to said cylinder and may be fixedly located at varying longitudinally spaced positions with respect to each other to permit the grinding of the compressor stuffing box end face for compressor stuffing boxes of varying length and size bores.

2. The stuffing box refacing tool as claimed in claim 1, wherein a locking collar having an internal diameter on the order of said cylinder outer diameter between said shoulders and the ends thereof is positioned between said second adaptor ring and said second shoulder and includes means for axially locking said collar to said cylinder such that when said second adaptor ring contacts the shoulder of said pump stuffing box cylindrical portion, said locking collar prevents further axial movement of said adaptor ring and said cylinder, while permitting said mandrel and said grinding wheel disc to shift axially until the end face of the grinding wheel disc abuts the end face of the pump stuffing box cylindrical portion to be refaced.

3. The stuffing box refacing tool as claimed in claim 1, wherein said mandrel comprises an enlarged diameter head at the end projecting axially outwardly from said stuffing box cylindrical portion bearing the end face to be refaced, said end of said pilot mandrel is axially tapped and threaded, and said tool further comprises a drive head rod having a reduced diameter threaded end threadably received by the tapped and threaded head end of said pilot mandrel, an intermediate diameter portion bearing said grinding wheel disc and a further enlarged diameter portion bearing on said grinding wheel disc and compressing said disc between that portion and the end face of the headed end of said pilot mandrel; whereby, said drive head may carry grinding wheel discs of varying thickness, depending upon the nature of the pump stuffing box cylindrical portion to be refaced.

4. The stuffing box refacing tool as claimed in claim 2, wherein said mandrel comprises an enlarged diameter head at the end projecting axially outwardly from said stuffing box cylindrical portion bearing the end face to be refaced, said end of said pilot mandrel is axially tapped and threaded, and said tool further comprises a drive head rod having a reduced diameter threaded end threadably received by the tapped and threaded head end of said pilot mandrel, an intermediate diameter portion bearing said grinding wheel disc and a further enlarged diameter portion bearing on said grinding wheel disc and compressing said disc between that portion and the end face of the headed end of said pilot mandrel; whereby, said drive head may carry grinding wheel discs of varying thickness, depending upon the nature of the pump stuffing box cylindrical portion to be refaced.

* * * * *